US008148474B2

(12) United States Patent
Ohama et al.

(10) Patent No.: US 8,148,474 B2
(45) **Date of Patent: *Apr. 3, 2012**

(54) GOLF BALL

(75) Inventors: Keiji Ohama, Kobe (JP); Hirotaka Nakamura, Kobe (JP); Toshiyuki Tarao, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 579 days.

This patent is subject to a terminal disclaimer.

(21) Appl. No.: 12/343,558

(22) Filed: Dec. 24, 2008

(65) Prior Publication Data

US 2009/0170637 A1 Jul. 2, 2009

(30) Foreign Application Priority Data

Dec. 28, 2007 (JP) ..... 2007-341233

(51) Int. Cl.
*A63B 37/12* (2006.01)
*A63B 37/00* (2006.01)
*C08L 75/00* (2006.01)

(52) U.S. Cl. ..... 525/438; 525/111; 525/127; 525/129; 525/440.09; 525/440.11; 525/440.12; 525/454; 525/457; 525/458; 473/378

(58) Field of Classification Search ..... None
See application file for complete search history.

(56) References Cited

U.S. PATENT DOCUMENTS

| | | | | |
|---|---|---|---|---|
| 3,989,568 | A | 11/1976 | Isaac | |
| 5,271,964 | A * | 12/1993 | Ohishi | 427/386 |
| 5,334,673 | A | 8/1994 | Wu | |
| 5,908,358 | A | 6/1999 | Wu | |
| 6,123,628 | A | 9/2000 | Ichikawa et al. | |
| 6,525,124 | B1 | 2/2003 | Hiraoka et al. | |
| 6,747,100 | B2 | 6/2004 | Ichikawa et al. | |
| 6,764,415 | B2 | 7/2004 | Ichikawa et al. | |
| 7,090,799 | B2 | 8/2006 | Takesue et al. | |
| 2003/0027666 | A1 * | 2/2003 | Watanabe et al. | 473/371 |
| 2003/0064831 | A1 | 4/2003 | Ichikawa et al. | |
| 2003/0064832 | A1 | 4/2003 | Ichikawa et al. | |
| 2004/0214964 | A1 * | 10/2004 | Kim et al. | 525/454 |
| 2005/0202904 | A1 * | 9/2005 | Takesue et al. | 473/378 |
| 2008/0161128 | A1 | 7/2008 | Manami et al. | |
| 2009/0170636 | A1 * | 7/2009 | Kamino et al. | 473/374 |

FOREIGN PATENT DOCUMENTS

| | | | |
|---|---|---|---|
| JP | 51-74726 | A | 6/1976 |
| JP | 9-94311 | A | 4/1997 |
| JP | 2662909 | B2 | 10/1997 |
| JP | 11-178949 | A | 7/1999 |
| JP | 2000-513596 | A | 10/2000 |
| JP | 2002-336378 | A | 11/2002 |
| JP | 2002-336386 | A | 11/2002 |
| JP | 2005-253962 | A | 9/2005 |

OTHER PUBLICATIONS

U.S. Office Action issued on Jun. 30, 2011 in U.S. Appl. No. 12/343,680.

Office Action dated Jan. 24, 2012 for corresponding Japanese Application No. 2007-341233.

* cited by examiner

*Primary Examiner* — David Buttner

(74) *Attorney, Agent, or Firm* — Birch, Stewart, Kolasch & Birch, LLP

(57) ABSTRACT

An object of the present invention is to provide a golf ball which has excellent durability and wear-resistance and provides an excellent shot feeling. The present invention is directed to a golf ball comprising: a core; and a cover covering the core, wherein the cover is formed from a cover composition containing a thermoplastic polyurethane (A), a polyisocyanate (B) having at least two isocyanate groups, and a polyhydroxyether (C) as a resin component, and wherein the core has a surface hardness of 85 or smaller in JIS-C hardness.

18 Claims, 3 Drawing Sheets

GOLF BALL

FIELD OF THE INVENTION

The present invention relates to a golf ball having a urethane cover, and more particularly, to a golf ball which has excellent durability and wear-resistance and provides an excellent shot feeling.

DESCRIPTION OF THE RELATED ART

Recently, a golf ball containing polyurethane as a resin component constituting a cover has been developed (e.g. Japanese Patent Publication No. S51-74726 A and Japanese Patent No. 2662909 B).

However, since a golf ball has insufficient durability when polyurethane is used for the cover, various technologies for improving covers containing polyurethane have been studied. For example, Japanese Patent Publication No. H11-178949 A discloses a golf ball which comprises a reaction product of a thermoplastic polyurethane elastomer and a blocked isocyanate as a main component of a resin component forming a cover. Japanese Patent Publications No. 2002-336378A, No. 2002-336386A, and No. 2005-253962 A disclose a golf ball having a cover which is formed from a composition containing a polyurethane material and an isocyanate mixture. Japanese Patent Publication No. 2000-513596 A discloses a golf ball having a cover being produced from a polyurethane composition containing an organic curing agent having at least one epoxy group.

Meanwhile, there are golf balls called "range balls" intended to be used mainly in driving ranges. It is known that such range balls require more excellent durability than golf balls for round games (e.g. Japanese Patent Publication No. H09-94311 A).

SUMMARY OF THE INVENTION

However, the golf balls disclosed in the above Patent documents do not satisfy the durability and the wear-resistance which are required for range balls, and provides the insufficient shot feeling. The golf ball disclosed in Japanese patent publication No. H09-94311 A has good durability but still leaves room for further improvement.

The present invention has been made in view of the above circumstance, and an object of the present invention is to provide a golf ball which has excellent durability and wear-resistance and provides an excellent shot feeling.

A golf ball of the present invention which has solved the above problems comprises a core; and a cover covering the core, wherein the cover is formed from a cover composition containing a thermoplastic polyurethane (A), a polyisocyanate (B) having at least two isocyanate groups, and a polyhydroxyether (C) as a resin component, and wherein the core has a surface hardness of 85 or smaller in JIS-C hardness.

In the present invention, since the cover is formed from a cover composition containing the thermoplastic polyurethane (A), the polyisocyanate (B) having at least two isocyanate groups, and the polyhydroxyether (C) as a resin component, and the core has a surface hardness of 85 or smaller in JIS-C hardness, a golf ball, which has a cover satisfying wear-resistance and durability required for a range ball and provides an excellent shot feeling, is obtained.

Generally, if a soft material such as a thermoplastic polyurethane is used as a resin component of the cover material, the durability of the cover is improved but wear-resistance tends to be lower. However, in the present invention, since the cover composition contains the thermoplastic polyurethane (A), the polyisocyanate (B), and the polyhydroxyether (C) as a resin component, the thermoplastic polyurethane (A) as a soft material and the polyhydroxyether (C) as a hard material are crosslinked with the polyisocyanate (B). As a result, the wear-resistance of the resultant cover is considered to be improved.

Further, in the case of using a polyisocyanate mixture (B+b) where a polyisocyanate (B) is dispersed in a thermoplastic resin (b) which does not substantially react with an isocyanate group as the polyisocyanate (B), the crosslinking reaction can be suppressed during the cover molding process, and promoted after the cover molding process. Thus, the abrasion-resistance and the durability of the cover can be improved without lowering productivity of the golf ball.

The polyhydroxyether (C) preferably has a repeating structural unit represented by the following Formula (1).

[Formula 1]

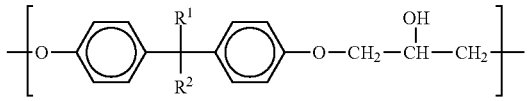

(1)

wherein $R^1$ an $R^2$ are the same or different from each other, and each are a hydrogen atom or a methyl group.

It is more preferable that the polyhydroxyether (C) is represented by the following Formula (2). Use of the polyhydroxyether represented by the following Formula (2) can further improve the wear-resistance of the cover.

[Formula 2]

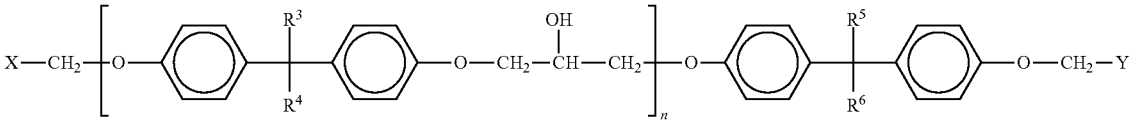

(2)

wherein $R^3$, $R^4$, $R^5$, $R^6$ are the same or different from each other, and each are a hydrogen atom or a methyl group; X and Y are the same or different from each other, and each are an epoxy group or a hydroxyethyl group; and n is a positive integer.

It is preferable that the polyhydroxyether (C) has a number average molecular weight in a range from 100 to 100,000. It is also preferable that a content of the polyhydroxyether (C) is 1 to 20 parts by mass with respect to 100 parts by mass of the thermoplastic polyurethane (A).

Further, it is preferable that a difference ($D_1-D_2$) between a compression deformation amount $D_1$ of the core and a compression deformation amount $D_2$ of the golf ball ranges from 0 mm to 0.4 mm. Making the compression deformation amount difference ($D_1-D_2$) within the above range can improve the shot feeling of the golf ball.

The present invention provides a golf ball which has excellent wear-resistance and durability and provides an excellent shot feeling.

DESCRIPTION OF THE PREFERRED EMBODIMENT

Figure 1:
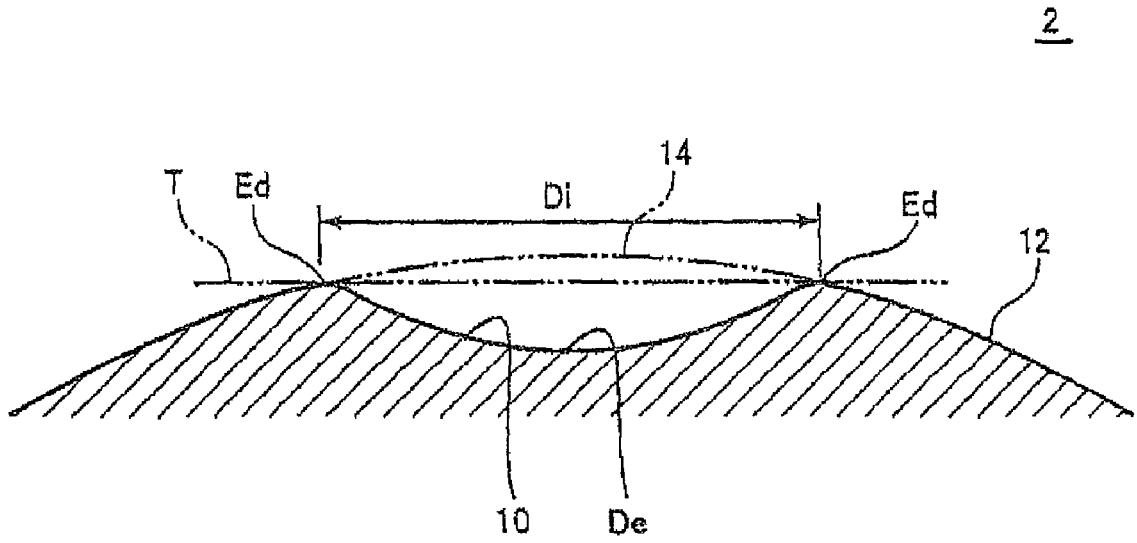
FIG. 1 is an enlarged cross-sectional view of a dimple formed on a surface of a golf ball.

The present invention is directed to a golf ball comprising:

a core; and a cover covering the core, wherein the cover is formed from a cover composition containing a thermoplastic polyurethane (A), a polyisocyanate (B) having at least two isocyanate groups, and a polyhydroxyether (C) as a resin component, and wherein the core has a surface hardness of 85 or smaller in JIS-C hardness.

First, the thermoplastic polyurethane (A) will be explained. The thermoplastic polyurethane (A) used in the present invention is not particularly limited, as long as it has a plurality of urethane bonds in a molecule and exhibits thermoplasticity. For example, the thermoplastic polyurethane is a reaction product obtained by reacting a polyisocyanate with a high molecular weight polyol to form urethane bonds in a molecule thereof, where necessary, obtained by further carrying out a chain extension reaction with a chain extender such as a low-molecular weight polyol and a low-molecular weight polyamine.

The polyisocyanate component, which constitutes the thermoplastic polyurethane (A), is not limited as long as it has at least two isocyanate groups. Examples of the polyisocyanate include an aromatic polyisocyanate such as 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylenediisocyanate (TMXDI), para-phenylene diisocyanate (PPDI); an alicyclic polyisocyanate or aliphatic polyisocyanate such as 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), and norbornene diisocyanate (NBDI). These may be used either alone or as a mixture of at least two of them.

In view of improving the abrasion-resistance, the aromatic polyisocyanate is preferably used as the polyisocyanate component of the thermoplastic polyurethane (A). A use of the aromatic polyisocyanate improves the mechanical property of the obtained polyurethane and provides the cover with the excellent abrasion-resistance. In addition, in view of improving the weather resistance, as the polyisocyanate component of the thermoplastic polyurethane (A), a non-yellowing type polyisocyanate such as TMXDI, XDI, HDI, $H_6$XDI, IPDI, $H_{12}$MDI and NBDI is preferably used. More preferably, 4,4'-dicyclohexylmethane diisocyanate ($H_{12}$MDI) is used. Since 4,4'-dicyclohexylmethane diisocyanate ($H_{12}$MDI) has a rigid structure, the mechanical property of the resulting polyurethane is improved, and thus the cover which is excellent in abrasion-resistance can be obtained.

The polyol component constituting the thermoplastic polyurethane (A) is not particularly limited as long as it has a plurality of hydroxyl groups, and such examples include a low-molecular weight polyol and a high-molecular weight polyol. Examples of the low-molecular weight polyol may include a diol such as ethylene glycol, diethylene glycol, triethylene glycol, propanediol (e.g., 1,2-propanediol, 1,3-propanediol, and 2-methyl-1,3-propanediol), dipropyleneglycol, butanediol (e.g., 1,2-butanediol, 1,3-butanediol, 1,4-butanediol, 2,3-butanediol, and 2,3-dimethyl-2,3-butanediol), neopentylglycol, pentanediol, hexanediol, heptanediol, octanediol, 1,6-cyclohexanedimethylol, an aniline diol, and bisphenol A diol; a triol such as glycerin, trimethylol propane, and hexanetriol; a tetraol or a hexanol such as pentaerythritol and sorbitol.

Examples of the high-molecular weight polyol include a polyether polyol such as polyoxyethylene glycol (PEG), polyoxypropylene glycol (PPG), and polyoxytetramethylene glycol (PTMG); a condensed polyester polyol such as polyethylene adipate (PEA), polybutylene adipate (PBA), and polyhexamethylene adipate (PHMA); a lactone polyester polyol such as poly-ϵ-caprolactone (PCL); a polycarbonate polyol such as polyhexamethylene carbonate; and an acrylic polyol. The above polyols may be used alone or as a mixture of at least two of them.

A number average molecular weight of the high-molecular weight polyol is not particularly limited, and for example, it is preferably 400 or more, more preferably 1,000 or more. If the number average molecular weight of the high-molecular weight polyol is made 400 or more, the resultant polyurethane does not become too hard and the shot feeling of the golf ball is improved. The upper limit of the number average molecular weight of the high molecular weight polyol is not particularly limited, and it is preferably 10,000, more preferably 8,000. The number average molecular weight of the polyol component can be measured by Gel permeation Chromatography using two columns of TSK-CEL SUPREH 2500 (TOSOH Corporation) as a column, polystyrene as a standard material, and tetrahydrofuran as an eluate.

The high-molecular weight polyol, used as the polyol component, has a hydroxyl value of 150 mgKOH/g or less, more preferably 120 mgKOH/g or less, even more preferably 60 mgKOH/g or less. The hydroxyl value of the high molecular weight polyol can be measured for example, by an acetylation method according to JIS K1557-1.

The polyamine component that constitutes the thermoplastic polyurethane where necessary may include any polyamine, as long as it has at least two amino groups. The polyamine includes an aliphatic polyamine such as ethylenediamine, propylenediamine, butylenediamine, and hexamethylenediamine, an alicyclic polyamine such as isophoronediamine, piperazine, and an aromatic polyamine.

The aromatic polyamine has no limitation as long as it has at least two amino groups directly or indirectly bonded to an aromatic ring. Herein, the "indirectly bonded to the aromatic ring", for example, means that the amino group is bonded to the aromatic ring via a lower alkylene bond. Further, the aromatic polyamine includes, for example, a monocyclic aromatic polyamine having at least two amino groups bonded to one aromatic ring or a polycyclic aromatic polyamine having at least two aminophenyl groups each having at least one amino group bonded to one aromatic ring.

Examples of the monocyclic aromatic polyamine include a type such as phenylenediamine, tolylenediamine, diethyltoluenediamine, and dimethylthiotoluenediamine wherein amino groups are directly bonded to an aromatic ring; and a type such as xylylenediamine wherein amino groups are bonded to an aromatic ring via a lower alkylene group. Further, the polycyclic aromatic polyamine may include a poly (aminobenzene) having at least two aminophenyl groups directly bonded to each other or a compound having at least two aminophenyl groups bonded via a lower alkylene group or an alkylene oxide group. Among them, a diaminodiphenylalkane having two aminophenyl groups bonded to each other via a lower alkylene group is preferable. Typically preferred are 4,4'-diaminodiphenylmethane or the derivatives thereof.

The thermoplastic polyurethane (A) has no limitation on the constitutional embodiments thereof. Examples of the constitutional embodiments are the embodiment where the polyurethane consists of the polyisocyanate component and the high-molecular weight polyol component; the embodiment where the polyurethane consists of the polyisocyanate component, the high-molecular weight polyol component and the low-molecular weight polyol component; and the embodiment where the polyurethane consists of the polyisocyanate component, the high-molecular weight polyol component, the low-molecular weight polyol component, and the polyamine component; and the embodiment where the polyurethane consists of the polyisocyanate component, the high-molecular weight polyol component and the polyamine component.

The thermoplastic polyurethane (A) preferably has a slab hardness in shore D hardness of 38 or larger, and more preferably 40 or larger, and preferably has a slab hardness in shore D hardness of 55 or smaller, and more preferably 52 or smaller, and even more preferably 50 or smaller. Making the hardness of the thermoplastic polyurethane (A) equal to or larger than 38 in shore D hardness prevents the cover composition from becoming too soft, thereby obtaining excellent resilient performance of the golf ball. Making the hardness of the thermoplastic polyurethane (A) equal to or smaller than 55 in shore D hardness prevents the cover from becoming too hard, thereby obtaining sufficient durability of the cover. Specific examples of the thermoplastic polyurethane (A) are "Elastollan (registered trademark) 1195ATR, Elastollan 1198ATR, and Elastollan 1154D" available from BASF Japan Ltd.

The following will describe the polyisocyanate (B) having at least two isocyanate groups.

The polyisocyanate (B) is not limited, as long as it has two or more isocyanate groups. Examples of the polyisocyanate (B) include a diisocyanate, a triisocyanate, and an isocyanate-containing urethane prepolymer. As the polyisocyanate (B), preferably used is a polyisocyanate mixture (B+b) where the polyisocyanate (B) is dispersed into a thermoplastic resin (b) which does not substantially react with an isocyanate group.

Examples of the diisocyanate include 2,4'-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylenediisocyanate (TMXDI), para-phenylene diisocyanate (PPDI), 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), and norbornene diisocyanate (NBDI).

Examples of the triisocyanate include a trifunctional isocyanate such as triphenyl methane triisocyanate, tris(isocyanatephenyl)thiophosphate, lysin estertriisocyanate, 1,6,11-undecane triisocyanate, 1,8-diisocyanate-4-isocyanate methyloctane, 1,3,6-hexamethylene triisocyanate, and bicycloheptane triisocyanate; isocyanurate of diisocyanate such as hexamethylene diisocyanate (HDI) and hydrogenated xylylene diisocyanate ($H_6$XDI); an adduct obtained by reacting diisocyanate with a triol having a low-molecular weight such as trimethylol propane or glycerin (free diisocyanate are preferably removed from the adduct); an allophanate modified polyisocyanate; a biuret modified polyisocyanate, and the like. The allophanate modified polyisocyanate is, for example, a trifunctional polyisocyanate obtained by reacting diisocyanate with a diol having a low-molecular weight to form a urethane bond and further reacting the urethane bond with the diisocyanate, and the biuret modified polyisocyanate is, for example, a trifunctional polyisocyanate obtained by reacting a diisocyanate with a diamine having a low-molecular weight to form a urea bond and further reacting the urea bond with the diisocyanate.

The triisocyanate used in the present invention has a molecular weight of preferably 200 or larger, more preferably 350 or larger, and even more preferably 500 or larger, and preferably 2,500 or smaller, more preferably less than 2,000, even more preferably less than 1,500, and much more preferably less than 1,000. The molecular weight of the triisocyanate can be obtained, for example, by gel permeation chromatography.

The isocyanate-containing urethane prepolymer is not particularly limited, as long as it is a compound having a plurality of urethane bonds and two or more isocyanate groups in a molecule thereof, and having a lower molecular weight than that of the thermoplastic polyurethane (A). Such examples include an isocyanate group-terminated urethane prepolymer having urethane bonds formed in a molecule thereof by, for example, reacting a polyisocyanate and a polyol under a condition wherein the polyisocyanate is in excess. The blending ratio of the polyisocyanate component to the polyol component is preferably 1.1 or more, more preferably 1.2 or more, even more preferably 1.3 or more, and is preferably 3.0 or less, more preferably 2.5 or less, even more preferably 2.0 or less in a molar ratio (NCO/OH) of the isocyanate group (NCO) of the polyisocyanate component to the hydroxyl group (OH) of the polyol component.

The polyisocyanate component used as a raw material for the isocyanate containing urethane prepolymer is not limited, as long as the polyisocyanate has at least two isocyanate groups. Examples of the polyisocyanate component include polyisocyanates exemplified as the polyisocyanate constituting the thermoplastic polyurethane (A). The polyol component used as a raw material for the isocyanate-containing urethane prepolymer is not limited, as long as the polyol component has a plurality of hydroxyl groups Examples of the polyol component include polyols such as a high-molecular weight polyol and a low-molecular weight polyol exemplified as the polyol component constituting the thermoplastic polyurethane (A).

The isocyanate group-terminated urethane prepolymer used as the isocyanate-containing urethane prepolymer includes TDI based urethane prepolymer, MDI based urethane prepolymer, and $H_{12}$MDI based urethane prepolymer. Preferably used is MDI based urethane prepolymer or $H_{12}$MDI based urethane prepolymer. Herein, TDI based urethane prepolymer means an isocyanate group terminated urethane prepolymer obtained by reacting TDI or a polyisocyanate compound containing TDI as a main component with a polyol (preferably PTMG); MDI based urethane prepolymer means an isocyanate group terminated urethane prepolymer obtained by reacting MDI or a polyisocyanate compound containing MDI as a main component with a polyol (preferably PTMG), and $H_{12}$MDI based urethane prepolymer means an isocyanate group terminated urethane prepolymer obtained by reacting $H_{12}$MDI or a polyisocyanate compound containing $H_{12}$MDI with a polyol (preferably PTMG).

For a reaction between the polyisocyanate component and the polyol component, a catalyst which is publicly known for being used in the urethane reaction can be used. Examples of the catalyst include a monoamine such as triethylamine and N,N-dimethylcyclohexylamine; a polyamine such as N,N,N',N'-tetramethylethylenediamine and N,N,N',N",N"-pentamethyldiethylenetriamine; a cyclic diamine such as 1,8-diazabicyclo[5,4,0]-7-undecene (DBU) and triethylenediamine; a tin catalyst such as dibutyltin dilaurylate and dibutyltin diacetate; an organic carboxylic acid such as acetic acid, azelaic acid, oleic acid and adipic acid.

A number average molecular weight of the urethane prepolymer is preferably, for example, 1,000 or more, more preferably 1,500 or more, even more preferably 2,000 or more, and is preferably 30,000 or less, more preferably 20,000 or less, even more preferably 10,000 or less. If the number average molecular weight is 1,000 or more, a distance between crosslinking points in the crosslinking reaction becomes longer, so that the resultant polyurethane cover does not become too hard, thereby improving durability thereof. On the other hand, if the number average molecular weight is 30,000 or less, the crosslinking density does not become too low, so that the abrasion-resistance of the resultant cover is improved.

The isocyanate content (NCO %) in the polyisocyanate (B) is preferably 0.5 mass % or higher and preferably 45 mass % or lower. Making the isocyanate content in the polyisocyanate (B) equal to or higher than 0.5 mass % provides a sufficient crosslinking effect, thereby improving the abrasion-resistance of the resulting cover. If the isocyanate content in the polyisocyanate (B) is too large, the viscosity of the cover composition excessively increases, thereby causing a possibility that moldability will deteriorate. The isocyanate content (NCO %) in the polyisocyanate (B) can be represented as: 100×(number of moles of isocyanate groups in the polyisocyanate (B)×42 (the molecular weight of NCO))/(the total mass of the polyisocyanate (B)).

Especially, when the diisocyanate is used as the polyisocyanate (B), the isocyanate content (NCO %) in the polyisocyanate (B) is preferably 15 mass % or higher, more preferably 17.5 mass % orhigher, and even morepreferably 20 mass % or higher, and is preferably 45 mass % or lower, more preferably 42.5 mass % or lower, and even more preferably 40 mass % or lower.

When the triisocyanate is used as the polyisocyanate (B), the isocyanate content (NCO %) in the polyisocyanate (B) is preferably 10.0 mass % or higher, more preferably 12.5 mass % or higher, and even more preferably 15.0 mass % or higher, and is preferably 30.0 mass % or lower, more preferably 27.0 mass % or lower, and even more preferably 25.0 mass % or lower.

When the urethane prepolymer is used as the polyisocyanate (B), the isocyanate content (NCO %) in the polyisocyanate (B) is preferably 0.5 mass % or higher, more preferably 0.75 mass % or higher, and even more preferably 1.0 mass % or higher, and is preferably less than 10.0 mass %, more preferably 9.0 mass % or lower, even more preferably 6.0 mass % or lower, and much more preferably 3.0 mass % or lower.

The thermoplastic resin (b) which does not substantially react with an isocyanate group is not particularly limited as long as it is substantially inactive with an isocyanate group (That is, the thermoplastic resin (b) does not substantially have an active hydrogen reactive with an isocyanate group), and such examples include a polystyrene resin, a polyvinylchloride resin, an acrylic resin, an ABS resin, an ester rubber, a polycarbonate resin, a polyester resin (preferably polyethylene terephthalate), polyolefin, polyacetal, a difluoride resin, a tetrafluoride resin, and an ionomer resin. Among them, as the thermoplastic resin (b), a thermoplastic elastomer having rubber elasticity is preferable. For example, it is preferred to use at least one kind selected from the group consisting of a polyester elastomer, an acrylic elastomer, a styrene elastomer, an olefin elastomer, and a vinyl chloride elastomer. Examples of the polyester elastomer include "HYTREL" such as "HYTREL 3046", "HYTREL 3548" and "HYTREL 4047" manufactured by DU PONT-TORAY Co or "Primalloy" such as "Primalloy A 1500" manufactured by Mitsubishi Chemical Corporation, and examples of the styrene elastomer include "Rabalon" manufactured by Mitsubishi Chemical Corporation.

In the polyisocyanate mixture (B+b), a blending ratio of the polyisocyanate (B) to the thermoplastic resin (b) (a total of 100 mass %) is preferably: the polyisocyanate (B)/thermoplastic resin (b)=5 mass % to 50 mass %/50 mass % to 95 mass %, more preferably 10 mass % to 50 mass %/50 mass % to 90 mass %, even more preferably 20 mass % to 45 mass %/55 mass % to 80 mass %. If the blending ratio is outside the above range, a desired cross-linking structure may not be obtained, or the durability may be deteriorated due to the too high crosslinking degree.

The isocyanate content (NCO %) in the polyisocyanate mixture (B+b) can be represented as: 100×(number of moles of isocyanate groups in the polyisocyanate mixture (B+b)×42 (the molecular weight of NCO))/the total mass (g) of the polyisocyanate mixture (B+b). The isocyanate content (NCO %) in the polyisocyanate mixture (B+b) is preferably 0.025 mass % or higher, and 22.5 mass % or lower. If the isocyanate content (NCO %) in the polyisocyanate mixture (B+b) is smaller than the above range, a crosslinking effect may not be obtained, thereby deteriorating the abrasion-resistance of the cover. If the isocyanate content (NCO %) in the polyisocyanate mixture (B+b) is larger than the above range, the viscosity of the cover composition excessively increases, thereby causing a possibility that the moldability will deteriorate.

Especially, when the diisocyanate is used as the polyisocyanate (B), the isocyanate content (NCO %) in the polyisocyanate mixture (B+b) is preferably 0.075 mass % or higher, more preferably 0.90 mass % or higher, and even more preferably 1.5 mass % or higher, and is preferably 21 mass % or lower, more preferably 19 mass % or lower, and even more preferably 17 mass % or lower.

When the triisocyanate is used as the polyisocyanate (B), the isocyanate content (NCO %) in the polyisocyanate mixture (B+b) is preferably 5.0 mass % or higher, more preferably 7.0 mass % or higher, and even more preferably 8.5 mass % or higher, and preferably 30.0 mass % or lower, more preferably 20.0 mass % or lower, and even more preferably 12.0 mass % or lower.

When the urethane prepolymer is used as the polyisocyanate (B), the isocyanate content (NCO %) in the polyisocyanate mixture (B+b) is preferably 0.1 mass % or higher, more preferably 0.2 mass % or higher, and even more preferably 0.3 mass % or higher, and preferably 10.0 mass % or lower, more preferably 7.0 mass % or lower, and even more preferably 5.0 mass % or lower.

Examples of the polyisocyanate mixture (B+b) include "Crossnate EM-30" available from Dainichiseika Color & Chemicals Mfg. Co., Ltd.

The content of the polyisocyanate mixture (B+b) in the cover composition used in the present invention is preferably 1 part by mass or larger, more preferably 2 parts by mass or larger, and even more preferably 4 parts by mass or larger, and is preferably 20 parts by mass or smaller, more preferably 18 parts by mass or smaller, and even more preferably 15 parts by mass or smaller with respect to 100 parts by mass of the thermoplastic polyurethane (A). Making the content of the polyisocyanate mixture (B+b) within the above range prevents the crosslinking density from becoming too high and provides a sufficient crosslinked structure, thereby improving the durability of the cover.

The following will describe the polyhydroxyether (C). The polyhydroxyether (C) used in the present invention is not limited, as long as it has a plurality of ether bonds and at least two hydroxyl groups within a molecule.

Examples of the polyhydroxyether (C) include a polyether glycol such as polyoxyethylene glycol (PEG), polyoxypropylene glycol (PPG), and polyoxytetramethyleneglycol (PTMG); and an epoxy resin having two or more hydroxyl groups within the molecule. The polyhydroxyether (C) may be used solely, or in combination of at least two of them.

The polyhydroxyether (C) preferably has a repeating structural unit represented by the following Formula (1).

[Formula 1]

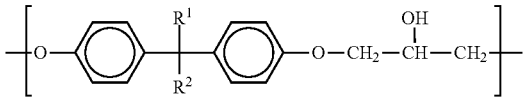

(1)

wherein $R^1$ an $R^2$ are the same or different from each other, and each are a hydrogen atom or a methyl group.

Using the polyhydroxyether (C) having the repeating structural unit represented by the above Formula (1) improves mechanical characteristics of the resulting cover composition, thereby obtaining a cover which has more excellent abrasion-resistance and durability.

In a more preferable embodiment, the polyhydroxyether (C) is represented by the following Formula (2).

[Formula 2]

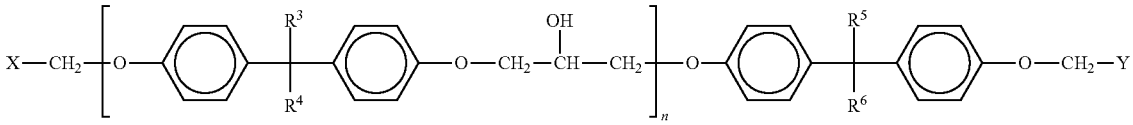

(2)

wherein $R^3$, $R^4$, $R^5$, $R^6$ are the same or different from each other, and each are a hydrogen atom or a methyl group; X and Y are the same or different from each other, and each are an epoxy group or a hydroxyethyl group; and n is a positive integer.

Examples of the polyhydroxyether (C) represented by the above Formula (2) include an epoxy resin such as bisphenol A type resin obtained by reacting bisphenol A with an epichlorohydrin, bisphenol F type resin obtained by reacting bisphenol F with an epichlorohydrin, and bisphenol AD type resin obtained by reacting bisphenol AD with an epichlorohydrin.

The polyhydroxyether (C) used in the present invention preferably has a number average molecular weight of 100 or larger, more preferably 300 or larger, and preferably has a number average molecular weight of 100,000 or smaller, and more preferably 80,000 or smaller. When the number average molecular weight of the polyhydroxyether (C) is equal to or larger than 100, the polyhydroxyether (C) has a sufficient amount of hydroxyl groups, and thus a sufficient crosslinking effect is obtained, thereby improving the wear-resistance of the cover. On the other hand, when the number average molecular weight of the polyhydroxyether (C) is equal to or smaller than 100,000, an amount of hydroxyl groups in the polyhydroxyether (C) is not excessive, and the crosslinking density does not become too high. Thus, the cover is not hard and fragile, thereby improving the durability of the cover.

When the epoxy resin is used as the polyhydroxyether (C), the polyhydroxyether (C) preferably has an epoxy equivalent of 1,000 g/eq or larger, more preferably 1,500 g/eq or larger, and even more preferably 2,000 g/eq or larger, and preferably has an epoxy equivalent of 20,000 g/eq or smaller, more preferably 15,000 g/eq or smaller, and even more preferably 10,000 g/eq or smaller. Herein, the epoxy equivalent is gram of resin containing 1 g equivalent of epoxy group, and has a value measured according to JIS K7236 standard.

Examples of the epoxy resin used as the polyhydroxyether (C) include a low-molecular-weight epoxy resin and a phenoxy resin. Herein, the phenoxy resin is a typical epoxy resin produced from an epichlorohydrin and a bisphenol among epoxy resins and having a relatively high molecular weight. The low-molecular-weight epoxy resin in the present invention preferably has a number average molecular weight of 1,000 or larger, more preferably 1,500 or larger, and preferably has a number average molecular weight of 8,000 or smaller, and more preferably 5,000 or smaller. The phenoxy resin in the present invention preferably has a weight average molecular weight of 10,000 or larger, more preferably 20,000 or larger, and preferably has a weight average molecular weight of 100,000 or smaller, and more preferably 80,000 or smaller.

Specific examples of the polyhydroxyether (C) include a solid-type epoxy resin having an epoxy equivalent of 1,750 g/eq to 3,300 g/eq such as "Epikote (registered trademark) 1007, 1009" available from Japan Epoxy Resins Co., Ltd., and a phenoxy-type epoxy resin having an epoxy equivalent of 7,000 g/eq to 8,500 g/eq such as "Epikote 1256".

The content of the polyhydroxyether (C) in the cover composition is preferably 1 part by mass or larger, more preferably 2 parts by mass or larger, and even more preferably 4 parts by mass or larger, and is preferably 20 parts by mass or smaller, more preferably 15 part by mass or smaller, and even more preferably 10 parts by mass or smaller with respect to 100 parts by mass of the thermoplastic polyurethane (A). Making the content of the polyhydroxyether (C) is equal to or larger than 1 part by mass provides a sufficient crosslinking effect, thereby improving the wear-resistance of the cover. On the other hand, making the content of the polyhydroxyether (C) equal to or smaller than 20 parts by mass provides sufficient resilient performance of the golf ball, because the content of the thermoplastic polyurethane (A) is not decreased relatively.

As the resin component, in addition to the thermoplastic polyurethane (A), the polyisocyanate (B), and the polyhydroxyether (C), another resin component can be added as long as it does not impair the effect of the present invention. However, in present invention, it is preferable that the cover composition essentially consists of the thermoplastic polyurethane (A), the polyisocyanate (B) having at least two isocyanate groups, and the polyhydroxyether (C) as the resin component.

Examples of the other resin component include an ionomer resin and a thermoplastic elastomer. Examples of the ionomer resin include one prepared by neutralizing at least a part of carboxyl groups in a copolymer composed of ethylene and α,β-unsaturated carboxylic acid having a carbon number of 3 to 8 with a metal ion; one prepared by neutralizing at least a part of carboxyl groups in a terpolymer composed of ethylene, α,β-unsaturated carboxylic acid having a carbon number of 3 to 8, and α,β-unsaturated carboxylic acid ester with a metal ion; and a mixture of these two. Specific examples of the ionomer resin include "HIMILAN (registered trademark)" available from DU PONT-MITSUI POLYCHEMICALS CO., LTD. "Surlyn (registered trademark)" available from E.I. du Pont de Nemours and Company and "Iotek (registered trademark)" available for ExxonMobile Chemical. Specific examples of the thermoplastic elastomer include a thermoplastic polyamide elastomer having a commercial name of "Pebax (registered trademark) (e.g. "Pebax 2533")" available from Arkema Inc., a thermoplastic polyester elastomer having a commercial name of "Hytrel (registered trademark) (e.g. "Hytrel 3548", "Hytrel 4047")" available from DU PONT-TORAY CO., LTD. or a commercial name of "Primalloy (registered trademark) (e.g. "Primalloy A1500")" available from Mitsubishi Chemical Corporation, and a thermoplastic polystyrene elastomer having a commercial name of "Rabalon (registered trademark)" available from Mitsubishi Chemical Corporation.

The cover composition used in the present invention may contain, other than the above-mentioned resin component, a pigment component such as titanium oxide and a blue pigment, a gravity adjusting agent such as calcium carbonate and barium sulfate, a dispersant, an antioxidant, an ultraviolet absorber, a light stabilizer, a fluorescent material or a fluorescent brightener to the extent that the cover performance is not damaged.

The content of the white pigment (titanium oxide) is preferably 0.5 part by mass or more, more preferably 1 part by mass or more, and preferably 10 parts by mass or less, more preferably 8 parts by mass or less based on 100 parts by mass of the thermoplastic polyurethane (A) constituting the cover. The white pigment in an amount of 0.5 part by mass or more can impart opacity to the cover, while the white pigment in an amount of more than 10 parts by mass may lower the durability of the resulting cover.

The cover composition of the present invention preferably has a slab hardness in shore D hardness of 40 or larger, more preferably 42 or larger, and preferably has a slab hardness in shore D hardness of 55 or smaller, more preferably 52 or smaller, and even more preferably 50 or smaller. Making the slab hardness of the cover composition equal to or larger than 40 in shore D hardness prevents the cover from becoming too soft, thereby obtaining sufficient resilient performance of the golf ball. Making the slab hardness of the cover composition equal to or smaller than 55 in shore D hardness prevents the cover from becoming too hard, thereby obtaining sufficient durability of the cover. Herein, the slab hardness of the cover means the hardness when measuring the hardness of the cover composition which is formed into a sheet, and the measuring method is described later.

In the method for preparing the golf ball of the present invention, the thermoplastic polyurethane (A) and the polyisocyanate (B) and the polyhydroxyether (C) are blended to obtain a cover composition. The blending of the cover composition is preferably carried out using, for example, a mixer capable of blending a raw material in the form of pellet, more preferably a tumbler type mixer. An embodiment of blending the cover composition include, for example, an embodiment of mixing an additive for the cover such as titanium oxide with the thermoplastic polyurethane (A) and subjecting the resultant mixture to extrusion to prepare a white pellet in advance, and then dry-blending the white pellet, the polyisocyanate (B) and the polyhydroxyether (C); an embodiment of mixing the polyisocyanate (B) and the additive for a cover such as titanium oxide, and subjecting the resultant mixture to extrusion to prepare a white pellet in advance and then dry-blending the white pellet, the thermoplastic polyurethane (A) and the polyhydroxyether (C); and an embodiment of mixing the thermoplastic polyurethane (A) the polyisocyanate (B) the polyhydroxyether (C) and the additive for a cover such as titanium oxide and subjecting the resultant mixture to extrusion to prepare a white pellet in advance.

An embodiment for molding a cover is not particularly limited, and includes an embodiment which comprises injection molding the cover composition directly onto the core, or an embodiment which comprises molding the cover composition into a hollow-shell, covering the core with a plurality of the hollow-shells and subjecting the core with a plurality of the hollow shells to the compression-molding (preferably an embodiment which comprises molding the cover composition into a half hollow-shell, covering the core with the two half hollow-shells, and subjecting the core with the two half hollow-shells to the compression-molding). In the case that the cover composition is subjected to injection molding onto the core, it is preferred to use upper and lower molds for forming a cover having a spherical cavity and pimples, wherein a part of the pimple also serves as a retractable hold pin. When forming the cover by injection molding, the hold pin is protruded to hold the core, and the cover composition which has been heated and melted is charged and then cooled to obtain a cover. For example, the cover composition heated and melted at the temperature of 150° C. to 230° C. is charged into a mold held under the pressure of 980 KPa to 1,500 KPa for 0.1 to 1 second. After cooling for 15 to 60 seconds, the mold is opened and the golf ball with the cover molded is taken out from the mold.

Molding of the half shell can be performed by either compression molding method or injection molding method, and the compression molding method is preferred. The compression-molding of the cover composition into half shell can be carried out, for example, under a pressure of 1 MPa or more and 20 MPa or less at a temperature of −20° C. or more and 70° C. or less relative to the flow beginning temperature of the cover composition. By performing the molding under the above conditions, a half shell having a uniform thickness can be formed. Examples of a method for molding the cover using half shells include compression molding by covering the core with two half shells. The compression molding of half shells into the cover can be carried out, for example, under a pressure of 0.5 MPa or more and 25 MPa or less at a temperature of −20° C. or more and 70° C. or less relative to the flow beginning temperature of the cover composition. By performing the molding under the above conditions, a cover for a golf ball having a uniform thickness can be formed. The crosslinking can be further promoted by post-curing the golf ball having the molded cover at the temperature of 40° C. or more for 4 hours to 96 hours.

In the present invention, use of the thermoplastic polyurethane (A) and the polyisocyanate (B), and the polyhydroxyether (C) suppresses the crosslinking reaction when molding the cover, and promotes the crosslinking reaction after molding the cover, thereby improving the abrasion-resistance of the cover without sacrificing the productivity of the golf ball. The crosslinking of the cover can be confirmed by the following method.

The thermoplastic polyurethane (A) crosslinked with the polyisocyanate (B) and the polyhydroxyether (C) is insoluble in the solvent in which the linear thermoplastic polyurethane (A) is soluble. The solvent in which the linear thermoplastic polyurethane (A) is soluble includes, for example, N,N-dimethylformamide (DMF), tetrahydrofuran (THF) or the like. Namely, the thermoplastic polyurethane (A) without being crosslinked is readily soluble in the solvent, but the thermoplastic polyurethane (A) crosslinked with the polyisocyanate (B) and the polyhydroxyether (C) is insoluble in the solvent. According to this difference, it is possible to confirm whether the thermoplastic polyurethane is crosslinked or not.

After the cover is molded, the mold is opened and the golf ball body is taken out from the mold, and as necessary, the golf ball body is preferably subjected to surface treatment such as deburring, cleaning, and sandblast. If desired, a paint film or a mark may be formed. There are no limitations on the thickness of the paint film, but preferably 5 μm or larger, and more preferably 7 μm or larger, and preferably 25 μm or smaller, and more preferably 18 μm or smaller. This is because if the thickness is smaller than 5 μm, the paint film is easy to wear off due to continued use of the golf ball, and if the thickness is larger than 25 μm, the effect of dimples is reduced, resulting in deteriorating the flying performance of the golf ball.

In the present invention, the cover of the golf ball has a thickness of preferably 1.0 mm or larger, more preferably 1.3 mm or larger, and is preferably 2.5 mm or smaller, more preferably 2.2 or smaller, and even more preferably 1.8 mm or smaller. Making the thickness of the cover equal to or larger than 1.0 mm provides the positive effects of the present invention and enhances the durability, and making the thickness of the cover equal to or smaller than 2.5 mm provides sufficient resilient of the golf ball.

When molding a cover, the concave portions called "dimple" are usually formed on the surface. FIG. 1 is an expanded sectional view of a part of a golf ball 2. This figure shows a cross-section which includes the deepest part De of a dimple 10 and the center of the golf ball 2. The up and down direction in FIG. 1 is the depth direction of the dimple 10. The depth direction is the direction from the gravity center of the area of the dimple 10 to the center of the golf ball 2. A chain double-dashed line 14 in FIG. 1 shows a virtual sphere. The surface of the virtual sphere 14 is the surface of the golf ball 2 in the case of assuming that there is no dimple 10. The dimple 10 is depressed in the virtual sphere 14. A land 12 corresponds to the virtual sphere 14.

Two headed arrow Di in FIG. 1 shows the diameter of the dimple 10. The diameter Di is the distance from one contact point Ed to another contact point Ed when a common tangent line T is drawn in both sides of the dimple 10. The contact points Ed are edges of the dimple 10. The edges Ed define the outline of the dimple 10. The diameter Di is preferably 2.0 mm or more and 6.0 mm or less. If the diameter Di is less than the above range, the dimple effect is hardly obtained and if the diameter Di exceeds 6.0 mm, the intrinsic property of the golf ball 2, that is, it is substantially spherical, is lost.

The area s of the dimple 10 is the area surrounded by the edge line in the case the center of the golf ball 2 is observed from infinity (that is, a plane area). The areas can be calculated according to a formula: $s=(Di/2)^2\times n$. The ratio of the total of the area s of all the dimples 10 occupying the surface area of the virtual sphere 14 is called as an occupation ratio. The occupation ratio is preferably 75% or higher from a viewpoint that a sufficient dimple effect can be obtained.

The volume of the dimple means the volume of the portion surrounded with the curved plane including the outline of the dimple 10 and the virtual sphere 14. The total volume of the dimples 10 is preferably 250 $mm^3$ or more and 400 $mm^3$ or less. If the total volume is less than 250 $mm^3$, a hopping trajectory may be provided in some cases. If the total volume exceeds 400 $mm^3$, a dropping trajectory may possibly be provided.

In FIG. 1, the distance between the tangent line T and the deepest point De is the depth of the dimple 10. The depth is preferably 0.05 mm or more and 0.60 mm or less. If the depth is less than 0.05 mm, a hopping trajectory may be provided in some cases. On the other hand, if the depth exceeds 0.60 mm, a dropping trajectory may possibly be provided. The total number of the dimples 10 is preferably 200 or more and 500 or less. If the total number is less than 200, the dimple effect is hardly obtained. On the other hand, if the total number exceeds 500, the dimple effect is hardly obtained because the size of the respective dimples 10 is small.

The golf ball of the present invention can have various structures or components as long as it is a golf ball comprising a core and a cover covering the core. However, preferable examples of the golf ball include a two-piece golf ball comprising a core, and a cover which covers the core; and a thread wound golf ball comprising a thread wound core, and a cover which covers the thread wound core. Among them, a two-piece golf ball comprising a core, and a cover which covers the core is more preferable.

The following will describe the core of the golf ball of the present invention.

The core used in the golf ball of the present invention preferably has a surface hardness of 85 or smaller in JIS-Chardness. Making the surface hardness of the core equal to or smaller than 85 in JIS-C hardness prevents the core from becoming too hard, thereby improving the shot feeling and the durability of the golf ball.

The core preferably has a surface hardness in JIS-C hardness of 70 or larger, more preferably 75 or larger, and even more preferably 77 or larger. When the surface hardness of the core is equal to or larger than 70 in JIS-Chardness, sufficient resilient of the golf ball is obtained. The core preferably has a surface hardness in JIS-C hardness of 85 or smaller, more preferably 83 or smaller, and even more preferably 80 or smaller. If the surface hardness of the core is larger than 85 in JIS-C hardness, the core becomes too hard, thereby deteriorating the shot feeling and the durability of the golf ball.

As the core of the golf ball of the present invention, a conventionally known rubber composition (hereinafter simply referred to as "core rubber composition" occasionally) may be employed, and it can be molded by, for example, heat-pressing a rubber composition containing a base rubber, a crosslinking initiator, a co-crosslinking agent, and a filler. The core preferably has a spherical shape. This is because if the core has a shape other than a spherical shape, the thickness of the cover becomes uneven. As a result, some portions where the cover performance is lowered may be generated.

As the base rubber, a natural rubber and/or a synthetic rubber such as a polybutadiene rubber, a natural rubber, a polyisoprene rubber, a styrene polybutadiene rubber, and ethylene-propylene-diene terpolymer (EPDM) may be used. Among them, typically preferred is the high cis-polybutadiene having cis-1,4 bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. An amount of the crosslinking initiator to be blended in the rubber composition is preferably 0.1 part by mass or more, more preferably 0.3 part by mass or more, even more preferably 0.5 part by mass or more, and is preferably 3 parts by mass or less, more preferably 2.8 parts by mass or less, even more preferably 2.5 parts by mass or less based on 100 parts by mass of the base rubber. If the amount is less than 0.1 part by mass, the core becomes too soft, and the resilience tends to be lowered, and if the amount is more than 3 parts by mass, the core becomes too hard, and the shot feeling may be lowered.

The co-crosslinking agent is not particularly limited as long as it has the effect of crosslinking a rubber molecule by graft polymerization with a base rubber molecular chain; for example, α,β-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and among them, zinc is preferred because it provides high resilience.

The amount of the co-crosslinking agent to be used is preferably 10 parts or more, more preferably 15 parts or more, and is preferably 50 parts or less, more preferably 45 parts or less based on 100 parts of the base rubber by mass. If the amount of the co-crosslinking agent to be used is less than 10 parts by mass, the amount of the organic peroxide must be increased to obtain an appropriate hardness, which tends to lower the resilience. On the other hand, if the amount of the co-crosslinking agent to be used is more than 50 parts by mass, the center becomes too hard, so that the shot feeling may be lowered.

The filler contained in the rubber composition for the core is mainly blended as a gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 2 parts or more, more preferably 3 parts or more, and preferably 50 parts or less, more preferably 35 parts or less based on 100 parts of the base rubber by mass. If the amount of the filler to be blended is less than 2 parts by mass, it becomes difficult to adjust the weight, while if it is more than 50 parts by mass, the weight ratio of the rubber component becomes small and the resilience tends to be lowered.

As the core rubber composition, an organic sulfur compound, an antioxidant or a peptizing agent may be blended appropriately in addition to the base rubber, the crosslinking initiator, the co-crosslinking agent and the filler.

As the organic sulfur compound, a diphenyl disulfide or a derivative thereof may be preferably used. Examples of the diphenyl disulfide or the derivative thereof include diphenyl disulfide, a mono-substituted diphenyl disulfide such as bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide and bis(4-cyanophenyl)disulfide; a di-substituted diphenyl disulfide such as bis(2,5-dichlorophenyl)disulfide, bis(3,5dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, and bis(2-cyano-5-bromophenyl)disulfide; a tri-substituted diphenyl disulfide such as bis(2,4,6-trichlorophenyl)disulfide, and bis(2-cyano-4-chloro-6-bromophenyl)disulfide; a tetra-substituted diphenyl disulfide such as bis(2,3,5,6-tetra chlorophenyl)disulfide; a penta-substituted diphenyl disulfide such as bis(2,3,4,5,6-pentachlorophenyl)disulfide and bis(2,3,4,5,6-pentabromophenyl)disulfide. These diphenyl disulfides or the derivative thereof can enhance resilience by having some influence on the state of vulcanization of vulcanized rubber. Among them, diphenyl disulfide and bis(pentabromophenyl) disulfide are preferably used since a golf ball having particularly high resilience can be obtained. The amount of the diphenyl disulfide or the derivative thereof to be blended is preferably 0.1 part by mass or more, more preferably 0.3 part by mass or more, and preferably 5.0 parts by mass or less, more preferably 3.0 parts by mass or less relative to 100 parts by mass of the base rubber.

The amount of the antioxidant to be blended is preferably 0.1 part or more and is preferably 1 part or less based on 100 parts of the base rubber by mass. Further, the peptizing agent is preferably 0.1 part or more and is preferably 5 parts or less based on 100 parts of the base rubber by mass.

The conditions for press-molding the rubber composition should be determined depending on the rubber composition. The press-molding is preferably carried out for 10 to 60 minutes at the temperature of 140 to 180° C. Alternatively, the press-molding is preferably carried out in a two-step heating, for example, for 20 to 40 minutes at the temperature of 130 to 180° C., and continuously for 5 to 15 minutes at the temperature of 160 to 180° C. When forming a core having a difference in the hardness between the surface hardness and the center hardness, it is preferable to heat for 10 to 60 minutes at the temperature of 130 to 200° C.

The core of the golf ball of the present invention has a diameter of preferably 36 mm or larger, more preferably 38 mm or larger, and even more preferably 38.6 mm or larger. This is because if the diameter of the core is smaller than 36 mm, the cover becomes too thick that the resilience of the golf ball is low. The core preferably has a diameter of 40.8 mm, and more preferably 40.6 mm. This is because if the diameter of the core is larger than 40.8 mm, the cover becomes too thin that a protection effect by the cover is not sufficiently obtained.

In the case that the core has a diameter from 36 mm to 40.8 mm, a compression deformation amount $D_1$ (shrinking deformation amount of the core along the compression direction) of the core when applying a load from 98 N as an initial load to 1275 N as a final load is preferably 2.8 mm or more, more preferably 3.0 mm or more, and is preferably 4.0 mm or less, more preferably 3.8 mm or less, even more preferably 3.5 mm or less. If the compression deformation amount $D_1$ is smaller than 2.8 mm, the shot feeling may be hard and bad, and if the compression deformation amount $D_1$ is larger than 4.0 mm, the resilience of the golf ball may be decreased.

When preparing a wound golf ball in the present invention, a wound core may be used as the core. In that case, for example, a wound core comprising a center formed by curing the above rubber composition for the core and a rubber thread layer which is formed by winding a rubber thread around the center in an elongated state can be used. In the present invention, the rubber thread, which is conventionally used for winding around the center, can be adopted for winding around the center. The rubber thread, for example, is obtained by vulcanizing a rubber composition including a natural rubber, or a mixture of a natural rubber and a synthetic polyisoprene, a sulfur, a vulcanization auxiliary agent, a vulcanization accelerator, and an antioxidant. The rubber thread is wound around the center in elongation of about 10 times length to form the wound core.

In the case that the golf ball of the present invention has a diameter from 42.5 mm to 43.0 mm, a compression deformation amount $D_2$ (shrinking deformation amount of the golf ball along the compression direction) of the golf ball when applying a load from 98 N as an initial load to 1275 N as a final load is preferably 2.4 mm or more, more preferably 2.6 mm or more, even more preferably 2.8 mm or more, and is preferably 4.0 mm or less, more preferably 3.5 mm or less, even more preferably 3.4 mm or less. If the compression deformation amount $D_2$ is smaller than 2.4 mm, the shot feeling may be hard and bad, and if the compression deformation amount $D_2$ is larger than 4.0 mm, the resilience of the golf ball may be decreased.

The difference ($D_1-D_2$) between the compression deformation amount $D_1$ of the core and the compression deformation amount $D_2$ of the golf ball is preferably 0 mm or larger, more preferably 0.1 mm or larger, and preferably 0.4 mm or smaller, and more preferably 0.3 mm or smaller. If the compression deformation amount difference ($D_1-D_2$) is smaller than 0 mm, in other words, if the compression deformation amount $D_2$ of the golf ball is larger than the compression deformation amount $D_1$ of the core, the resilience of the golf ball tends to be lower. On the other hand, if the compression deformation amount difference ($D_1-D_2$) is larger than 0.4 mm, the cover may be hard, thereby decreasing the durability of the golf ball.

EXAMPLES

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

[Evaluation Methods]

(1) Slab Hardness (Shore D Hardness)

Using the cover composition, a sheet having a thickness of about 2 mm were prepared by hot press molding and preserved at the temperature of 23° C. for two weeks. Three or more of the sheets were stacked on one another to avoid being affected by the measuring substrate on which the sheets were placed, and the stack was subjected to the measurement using P1 type auto hardness tester provided with the Shore D type spring hardness tester prescribed by ASTM-D2240, available from KOUBUNSHI KEIKI CO., LTD to obtain the respective slab hardness of the cover composition.

(2) Core Hardness (JIS-C Hardness)

Using the C type spring hardness tester specified by JIS-K 6301, the JIS-C hardness measured at a surface part of the spherical core was determined as the surface hardness of the core.

(3) Compression Deformation Amount (mm)

The compression deformation amount (amount the golf ball shrinks along the compression direction: mm) of the golf balls or the spherical cores was measured when applying a load from 98 N (10 kgf) as an initial load to 1275 N (130 kgf) as a final load to the golf balls or the cores.

(4) Repulsion Coefficient of Golf Balls

Aluminum cylinder having a weight of 200 g was collided with the resultant golf balls at the speed of 40 m/sec. to measure the speed of the cylinder and the golf ball before and after the collision. The repulsion coefficient of each golf ball was obtained based on each of the measured speed and weight. Each golf ball was measured 12 times to obtain the average. The repulsion coefficient measured in terms of each golf ball is reduced to an index number relative to the measured value obtained in Golf ball No.8 whose repulsion coefficient is assumed 1.00.

(5) Durability

Each golf ball was repeatedly hit with a metal head driver (manufactured by SRI Sports Ltd, XXIO) attached to a swing robot M/C manufactured by Golf Laboratories, at the head speed of 45 m/sec. Times up to which the golf balls are cracked were measured. In addition, each value obtained was reduced to an index number relative to the measured value obtained in Golf ball No.8 being assumed 100. The larger number indicates better durability.

(6) Wear-Resistance 2,500 g of grinding stones (product name "AT", model number 3 available from Tipton Corp.) and 2500 ml of water were put into a ball mill with a volume of 7L, and 40 to 50 golf balls were put therein. The ball mill was rotated at 50 rpm for 8 hours to perform a wear-resistance test.

Dimple volume of the golf balls after the wear-resistance test was measured, and a dimple volume decrease rate was calculated using the following mathematical expression 1.

Dimple volume decrease rate (%)=((dimple volume before wear-resistance test−dimple volume after wear resistance test)/dimple volume before wear-resistance test)×100 [Mathematical expression 1]

(7) Shot Feeling

An actual hitting test was carried out by ten golfers using a #1 wood club (#W1 driver), and evaluation was categorized into the following criteria depending on the number of golfers who answered "the golf ball has a small impact, a good resilience, and a excellent shot feeling".

E(Excellent): 8 out of 10 golfers answered that a shot feeling was excellent.

G(Good): 6 or 7 out of 10 golfers answered that a shot feeling was excellent.

F(Fair): 4 or 5 out of 10 golfers answered that a shot feeling was excellent.

P(Poor): 3 or less out of 10 golfers answered that a shot feeling was excellent.

[Preparation of Golf Ball]

(1) Preparation of Core

The rubber compositions shown in Table 1 were kneaded and pressed with upper and lower molds each having a spherical cavity at the heating condition of 170° C. for 30 minutes to obtain the spherical core having a diameter of 37.2 mm to 40.4 mm. The amount of Barium sulfate was adjusted to make a golf ball have a mass of 45.4 g.

TABLE 1

| | Core composition No. | | | |
|---|---|---|---|---|
| | 1 | 2 | 3 | 4 |
| BR730 | 100 | 100 | 100 | 100 |
| Zinc acrylate | 32 | 34 | 39 | 29 |
| Zinc oxide | 5 | 5 | 5 | 5 |
| Barium sulfate | Proper amount*) | Proper amount*) | Proper amount*) | Proper amount*) |
| Diphenyl disulfide | 0.5 | 0.5 | 0.5 | 0.5 |
| Dicumyl peroxide | 0.7 | 0.7 | 0.7 | 0.7 |

Notes on Table 1

Formulation: mass part

*)Adjusted to give golf ball weight of 45.4 g depending on the cover composition.

BR730: High cis-Polybutadiene rubber (cis-content 96% or more) manufactured by JSR Corporation Zinc acrylate: "ZNDA-90S" manufactured by NIHON JYORYU KOGYO Co,. LTD.

Zinc oxide: "Ginrei R" manufactured by Toho-Zinc Co.

Barium sulfate: barium sulfate BD manufactured by Sakai Chemical Industry Co. Ltd.

Dicumyl peroxide: "Percumyl D" manufactured by NOF Corporation

Diphenyl disulfide: manufactured by Sumitomo Seika Chemicals Company Limited (2) Preparation of the Cover Composition According to the formulation shown in Table 2, the thermoplastic polyurethane (A), the polyisocyanate (B), and the polyhydroxyether (C), and a filler for the cover (titanium dioxide) were dry-blended using a tumbler mixer to prepare cover compositions.

(3) Production of the Golf Ball Body

The resultant cover composition was injection-molded onto the core thus obtained to form the cover, thereby obtaining a two-piece golf ball body. The upper and lower molds for forming the cover have a spherical cavity with pimples. The part of the pimples can serve as a hold pin which is retractable. When forming the golf ball body, the hold pins were protruded to hold the core, and the resin heated at 210° C. was charged into the mold held under the pressure of 80 tons for 0.3 seconds. After the cooling for 30 seconds, the molds were opened and then the golf ball body was discharged.

The surface of the obtained golf ball body was subjected to a sandblast treatment and marking, and then clear paint was applied thereto and dried in an oven at a temperature of 40° C. for 4 hours to obtain a golf ball having a diameter of 42.8 mm and a weight of 45.4 g.

Figure 2:
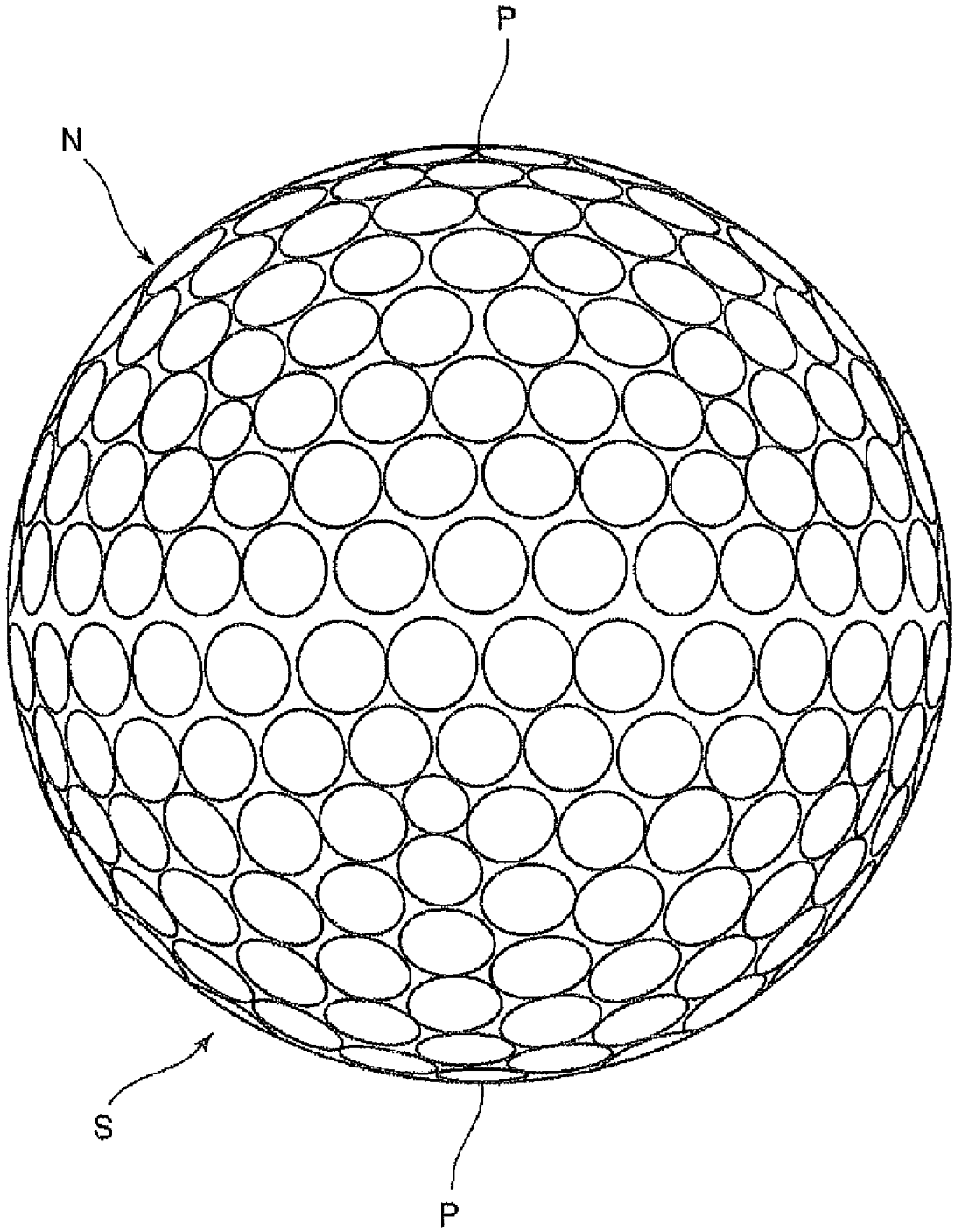
FIG. 2 is a front view of a dimple pattern formed on the surface of the golf ball.
Figure 3:
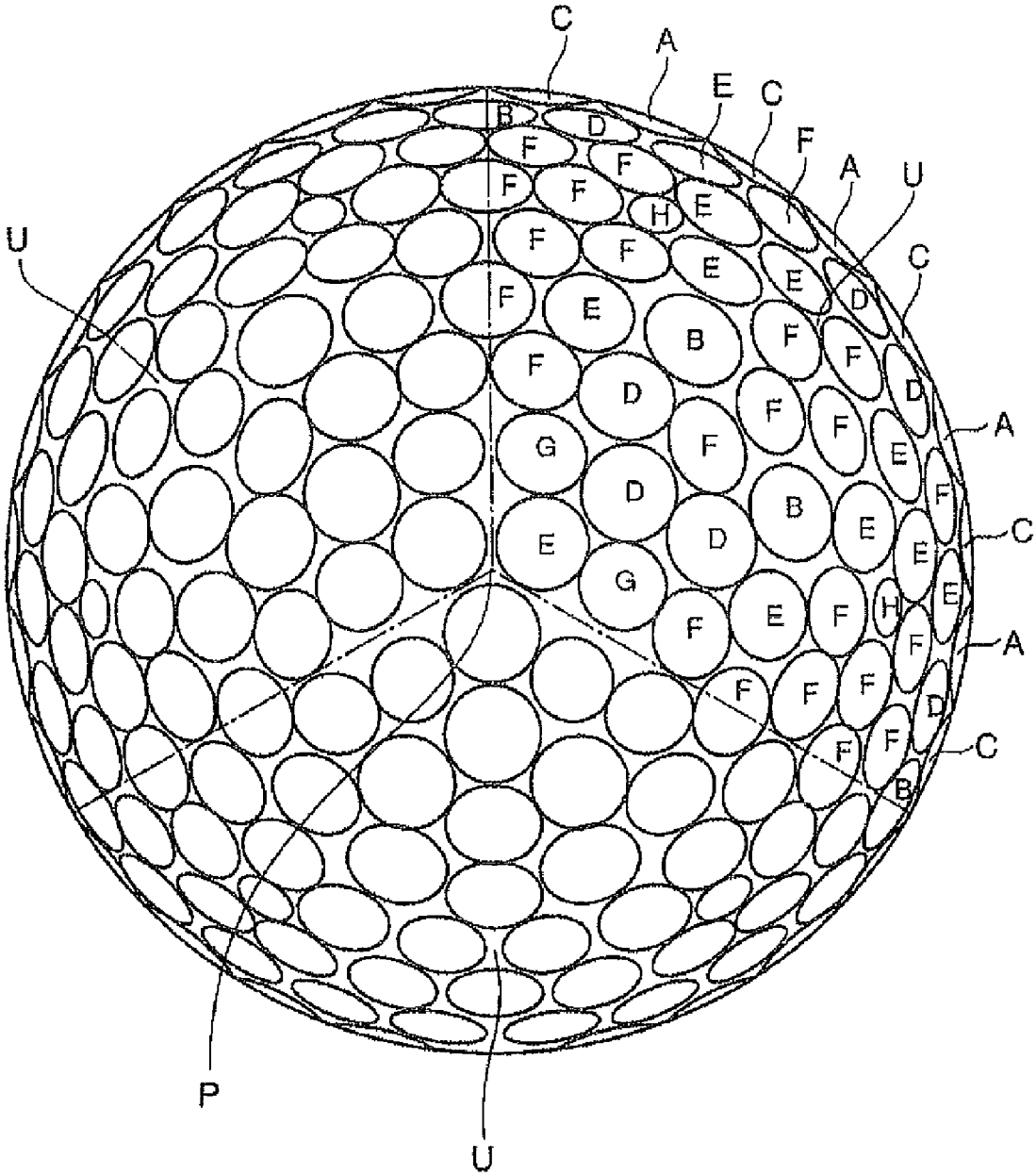
FIG. 3 is a plan view of the dimple pattern formed on the surface of the golf ball.

The dimple pattern shown in Table 2, FIG. 2 and FIG. 3 were formed on the surface of the golf ball. In the north hemisphere N and south hemisphere S of the golf ball, there is a unit U which has rotational symmetries through 120 degrees. In each of the north hemisphere N and the south hemisphere S, there are three units U. A total number of dimples formed on the surface of the golf ball was 330, a total volume of the dimples was 311 $mm^3$, and an occupancy ratio was 81.2%. FIG. 3 shows kinds of dimples by represented symbols A to H in one unit U.

TABLE 2

| Type | Number of dimples | Diameter (mm) | Depth (mm) | Radius of curvature (mm) | Volume ($mm^3$) |
|---|---|---|---|---|---|
| A | 24 | 4.75 | 0.140 | 20.22 | 1.242 |
| B | 18 | 4.65 | 0.140 | 19.38 | 1.190 |
| C | 30 | 4.55 | 0.135 | 19.24 | 1.099 |
| D | 42 | 4.45 | 0.135 | 18.40 | 1.051 |
| E | 66 | 4.25 | 0.135 | 16.79 | 0.959 |
| F | 126 | 4.05 | 0.130 | 15.84 | 0.839 |
| G | 12 | 3.95 | 0.130 | 15.07 | 0.798 |
| H | 12 | 2.80 | 0.120 | 8.23 | 0.370 |

Table 3 shows the compositions and the evaluation regarding durability, wear-resistance, shot feeling and other factors, of the resulting golf balls.

TABLE 3

| | | Golf ball No. | | | | | | | | | | |
|---|---|---|---|---|---|---|---|---|---|---|---|---|
| | | 1 | 2 | 3 | 4 | 5 | 6 | 7 | 8 | 9 | 10 | 11 |
| Core | Core Composition No. | 1 | 2 | 1 | 1 | 1 | 1 | 2 | 1 | 1 | 3 | 4 |
| | Diameter (mm) | 39.6 | 38.8 | 40.0 | 37.2 | 39.6 | 39.6 | 40.0 | 39.6 | 39.6 | 40.4 | 39.6 |
| | Deformation amount D1 (mm) | 3.4 | 3.1 | 3.4 | 3.4 | 3.4 | 3.4 | 3.1 | 3.4 | 3.4 | 2.6 | 3.7 |
| | Surface hardness (JIS-C) | 79 | 82 | 79 | 79 | 79 | 79 | 82 | 79 | 79 | 87 | 76 |
| Cover | (A) Thermoplastic polyurethane | 100 | 100 | 100 | 100 | 100 | 100 | 100 | 100 | 100 | 100 | — |
| | Himilan 1555 | — | — | — | — | — | — | — | — | — | — | 50 |
| | Himilan 1557 | — | — | — | — | — | — | — | — | — | — | 50 |
| | (C) Polyhydroxyether | — | — | — | — | — | — | — | — | — | — | — |
| | Epikote 1256 | 5 | 15 | 3 | 5 | — | — | — | — | — | 5 | — |
| | Epikote 1007 | — | — | — | — | 5 | — | — | — | — | — | — |
| | Epikote 1009 | — | — | — | — | — | 5 | — | — | — | — | — |
| | DER-331 | — | — | — | — | — | — | 5 | — | — | — | — |
| | (B + b) Polyisocyanate mixture | 5 | 10 | 2 | 5 | 5 | 5 | 5 | — | 5 | 5 | — |
| | Titanium oxide | 3 | 3 | 3 | 3 | 3 | 3 | 3 | 3 | 3 | 3 | 3 |
| | Slab hardness (shore D) | 48 | 49 | 47 | 48 | 48 | 48 | 47 | 47 | 48 | 48 | 58 |
| | Thickness (mm) | 1.6 | 2.0 | 1.4 | 2.8 | 1.6 | 1.6 | 1.4 | 1.6 | 1.6 | 1.2 | 1.6 |
| Golf ball Properties | Deformation amount D2 (mm) | 3.2 | 3.0 | 3.2 | 3.1 | 3.2 | 3.2 | 3.0 | 3.2 | 3.2 | 2.5 | 3.1 |
| | Deformation amount difference ($D_1 - D_2$) (mm) | 0.2 | 0.1 | 0.2 | 0.3 | 0.2 | 0.2 | 0.1 | 0.2 | 0.2 | 0.1 | 0.6 |

TABLE 3-continued

| | Golf ball No. | | | | | | | | | | |
|---|---|---|---|---|---|---|---|---|---|---|---|
| | 1 | 2 | 3 | 4 | 5 | 6 | 7 | 8 | 9 | 10 | 11 |
| Repulsion Coefficient | 1.00 | 1.01 | 1.01 | 0.98 | 1.00 | 1.00 | 1.01 | 1.00 | 1.00 | 1.02 | 1.03 |
| Durability | 103 | 110 | 101 | 115 | 101 | 102 | 100 | 100 | 102 | 93 | 80 |
| Wear-resistance (%) | 4 | 3 | 5 | 4 | 5 | 4 | 6 | 10 | 7 | 5 | 13 |
| Shot feeling | G | G | G | G | G | G | G | G | F | P | F |

Formulation: parts by mass.

Notes on Table 3

Thermoplasticpolyurethane (A): Elastollan1195ATR, anMDI-based thermoplastic polyurethane available from BASF Japan Ltd.

HIMILAN 1555: a sodium ion neutralized ethylene-methacrylic copolymer ionomer resin available from DU PONT-MITSUI POLYCHEMICALS CO., LTD.

HIMILAN 1557: a zinc ion neutralized ethylene-methacrylic copolymer ionomer resin available from DU PONT-MITSUI POLYCHEMICALS CO., LTD.

Epikote 1256: an epoxy resin (phenoxy-type, weight average molecular weight: about 50000, epoxy equivalent: 7000-8000 g/eq) available from Japan Epoxy Resins Co., Ltd.

Epikote 1007: an epoxy resin (basic solid-type, weight average molecular weight: about 2900, epoxy equivalent: 1750-2200 g/eq) available from Japan Epoxy Resins Co., Ltd.

Epikote 1009: an epoxy resin (basic solid-type, weight average molecular weight: about 3800, epoxy equivalent: 2400-3300 g/eq) available from Japan Epoxy Resins Co., Ltd.

DER-331: an epoxy resin (weight average molecular weight: about 340, epoxy equivalent: 180-190 g/eq) available from The Dow Chemical Company.

(B + b) Polyisocyanate mixture: Crossnate EM-30, a product, in which MDI is dispersed in thermoplastic polyester resin (MDI content: 30 mass %), available from Dainichiseika Color & Chemicals Mfg. Co., Ltd.

Golf balls Nos. 1 to 7 are the cases where the cover is formed from a cover composition containing thermoplastic polyurethane (A), a polyisocyanate (B) having at least two isocyanate groups, and polyhydroxyether (C) as a resin component, and wherein the core has a surface hardness of 85 or smaller in JIS-C hardness. It is found that these golf balls Nos. 1 to 7 have more excellent durability, wear-resistance and provide a more excellent shot feeling as compared with a golf ball No. 8 containing only thermoplastic polyurethane (A) as a resin component. Since the golf ball No. 7 contains polyhydroxyether (C) having a low molecular weight, its wear-resistance tends to be slightly lower.

A golf ball No. 9 is the case where the cover contains thermoplastic polyurethane (A) and polyisocyanate (B) having at least two isocyanate groups as a resin component. The golf ball No. 9 has improved durability and wear-resistance but inferior shot feeling as compared with the golf ball No. 8. The golf ball No. 10 is the case that the cover composition contains the thermoplastic polyurethane (A), polyisocyanate (B) having at least two isocyanate groups, and polyhydroxyether (C) as a resin component, but includes a core with a surface hardness of more than 85 in JIS-C hardness. The golf ball No. 10 has more excellent wear-resistance but inferior durability and shot feeling as compared with the golf ball No. 8. A golf ball No. 11 containing ionomer resin as a resin component is inferior in durability, wear-resistance, and shot feeling as compared with the golf ball No. 8.

The present invention is applicable to a golf ball having a urethane cover, and in particular, suitable for improving durability, wear-resistance, and shot feeling of a practice golf ball. This application is based on Japanese Patent application Nos. 2007-341233 filed on Dec. 28, 2007, the contents of which are hereby incorporated by reference.

What is claimed is:

1. A golf ball comprising:

a core; and a cover covering the core, wherein the cover is formed from a cover composition containing a thermoplastic polyurethane (A), a polyisocyanate (B) having at least two isocyanate groups, and a polyhydroxyether (C) as a resin component, wherein the core has a surface hardness of 85 or smaller in JIS-C hardness, and wherein the polyhydroxyether (C) has a repeating structural unit represented by Formula (1):

(1)

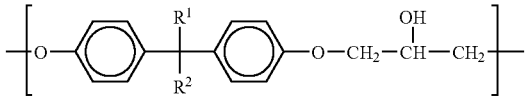

wherein $R^1$ and $R^2$ are the same or different from each other, and each are a hydrogen atom or a methyl group.

2. The golf ball according to claim 1, wherein the polyhydroxyether (C) has a number average molecular weight in a range from 100 to 100,000.

3. The golf ball according to claim 1, wherein the polyhydroxyether (C) is an epoxy resin having an epoxy equivalent ranging from 1,000 g/eq to 20,000 g/eq.

4. The golf ball according to claim 1, wherein the polyhydroxyether (C) is an epoxy resin having a number average molecular weight ranging from 1,000 to 8,000.

5. The golf ball according to claim 1, wherein the polyhydroxyether is a phenoxy resin having a weight average molecular weight ranging from 10,000 to 100,000.

6. The golf ball according to claim 1, wherein a content of the polyhydroxyether (C) is 1 to 20 parts by mass with respect to 100 parts by mass of the thermoplastic polyurethane (A).

7. The golf ball according to claim 1, wherein the polyisocyanate (B) is a polyisocyanate mixture (B+b) where the polyisocyanate (B) is dispersed into a thermoplastic resin (b) which does not substantially react with an isocyanate group.

8. The golf ball according to claim 1, wherein the cover composition contains the polyisocyanate mixture (B+b) in an amount from 1 part to 20 parts with respect to 100 parts of the thermoplastic polyurethane (A) by mass.

9. The golf ball according to claim 1, wherein a difference ($D_1$−$D_2$) between a compression deformation amount $D_1$ of the core and a compression deformation amount $D_2$ of the golf ball ranges from 0 mm to 0.4 mm.

10. A golf ball comprising:

a core; and a cover covering the core, wherein the cover is formed from a cover composition containing a thermoplastic polyurethane (A), a polyisocyanate (B) having at least two isocyanate groups, and a polyhydroxyether (C) represented by the following formula(2) as a resin component, and wherein the core has a surface hardness of 85 or smaller in JIS-C hardness (2)

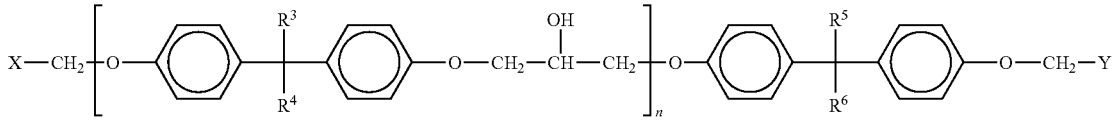

wherein $R^3$, $R^4$, $R^5$, $R^6$ are the same or different from each other, and each are a hydrogen atom or a methyl group; X and Y are the same or different from each other, and each are an epoxy group or a hydroxyethyl group; and n is a positive integer.

11. The golf ball according to claim 10, wherein the polyhydroxyether (C) has a number average molecular weight ranging from 100 to 100,000.

12. The golf ball according to claim 11, wherein the polyhydroxyether (C) is an epoxy resin having an epoxy equivalent ranging from 1,000 g/eq to 20,000 g/eq.

13. The golf ball according to claim 11, wherein the polyhydroxyether (C) is an epoxy resin having a number average molecular weight ranging from 1,000 to 8,000.

14. The golf ball according to claim 11, wherein the polyhydroxyether is a phenoxy resin having a weight average molecular weight ranging from 10,000 to 100,000.

15. The golf ball according to claim 11, wherein a content of the polyhydroxyether (C) is 1 to 20 parts by mass with respect to 100 parts by mass of the thermoplastic polyurethane (A).

16. The golf ball according to claim 15, wherein the polyisocyanate (B) is a polyisocyanate mixture (B+b) where the polyisocyanate (B) is dispersed into a thermoplastic resin (b) which does not substantially react with an isocyanate group.

17. The golf ball according to claim 16, wherein the cover composition contains the polyisocyanate mixture (B+b) in an amount from 1 part to 20 parts with respect to 100 parts of the thermoplastic polyurethane (A) by mass.

18. The golf ball according to claim 17, wherein a difference ($D_1$–$D_2$) between a compression deformation amount $D_1$ of the core and a compression deformation amount $D_2$ of the golf ball ranges from 0 mm to 0.4 mm.

* * * * *